US008051779B2

(12) United States Patent
Baranowski et al.

(10) Patent No.: US 8,051,779 B2
(45) Date of Patent: Nov. 8, 2011

(54) RAILCAR COVER

(75) Inventors: Kenneth M. Baranowski, Albion, IN (US); Arturo Machado, Elkhart, IN (US); Roy J. Huber, Goshen, IN (US)

(73) Assignee: Structural Composites of Indiana, Inc., Ligonier, IN (US)

( * ) Notice: Subject to any disclaimer, the term of this patent is extended or adjusted under 35 U.S.C. 154(b) by 316 days.

(21) Appl. No.: 12/269,153

(22) Filed: Nov. 12, 2008

(65) Prior Publication Data

US 2009/0235841 A1 Sep. 24, 2009

Related U.S. Application Data

(60) Provisional application No. 61/038,474, filed on Mar. 21, 2008.

(51) Int. Cl.
*B61D 39/00* (2006.01)

(52) U.S. Cl. ..... 105/377.09

(58) Field of Classification Search ..... 105/377.01, 105/377.09, 377.11; 296/100.01, 100.02–100.05
See application file for complete search history.

(56) References Cited

U.S. PATENT DOCUMENTS

| | | | | |
|---|---|---|---|---|
| 1,747,423 | A | | 2/1930 | Campbell |
| 1,847,132 | A | | 3/1932 | Morrow |
| 1,917,167 | A | | 7/1933 | Tucke |
| 3,169,492 | A | | 2/1965 | Stiefel et al. |
| 3,259,078 | A | | 7/1966 | Radey et al. |
| 3,628,828 | A | * | 12/1971 | Page et al. ..... 49/381 |
| 3,707,919 | A | | 1/1973 | Adler |
| 4,077,329 | A | | 3/1978 | Adler |
| 4,524,700 | A | | 6/1985 | Engdahl |
| RE32,189 | E | | 6/1986 | Adler et al. |
| 4,638,743 | A | | 1/1987 | Loomis |
| 5,311,824 | A | | 5/1994 | Sauer et al. |
| 6,092,471 | A | * | 7/2000 | Early ..... 105/377.07 |
| 7,003,850 | B2 | | 2/2006 | Gaydos et al. |
| 2002/0053167 | A1 | | 5/2002 | Hunter |

FOREIGN PATENT DOCUMENTS

| | | |
|---|---|---|
| JP | 53 020212 | 2/1978 |
| JP | 57 186575 | 11/1982 |
| JP | 58 067557 | 4/1983 |
| KR | 10 2004 0019757 | 3/2004 |

OTHER PUBLICATIONS

Ecofab Rail Wagon Covers, Feb./Mar. 2001, p. 89, Australian Bulk Handling Review.
International Search Report dated Nov. 3, 2009 for International Application No. PCT/US2009/037743.

* cited by examiner

*Primary Examiner* — Joe Morano, IV
*Assistant Examiner* — Zachary Kuhfuss
(74) *Attorney, Agent, or Firm* — Taylor IP, P.C.

(57) ABSTRACT

A railcar having a longitudinal axis and a movable cover. The movable cover includes a plurality of linear bearing devices and at least one slideable hatch connected to the plurality of linear bearing devices. The slideable hatch is movable substantially normal to the longitudinal axis.

8 Claims, 4 Drawing Sheets

RAILCAR COVER

This is a non-provisional application based upon U.S. provisional patent application Ser. No. 61/038,474, entitled "RAILCAR COVER", filed Mar. 21, 2008, which is incorporated herein by reference.

BACKGROUND OF THE INVENTION

1. Field of the Invention

The present invention relates to a cover system for a railcar, and, more particularly, to an opening and closing system for railcar covers.

2. Description of the Related Art

Bulk carrying railcars often have openings along the top that are opened for the loading of material and closed for transportation, some bulk railroad cars are utilized without any cover. It is desirous to protect the materials carried in the interior of the railroad car from damage, which may be caused by weather or other environmental sources of damage which may include particulate or biologic material contained in the area. It is also desirous to prevent the bulk material from being dissipated by transportation due to the air billowing over the bulk material while it is in transit. It is desirable to have a railcar open on top so as to provide an easy way of loading cargo from a delivering device, such as a hopper, that may be suspended over the top of the railroad car. It is known to have railroad car hatches that are hinged and which are opened by releasing the latches on one side and pivoting the covers to the other side thereby exposing a portion of the top of the railroad car so that material may be loaded therein. It is known to have sliding cover doors that employ rolling bearings located at each end of the railcar. This type of device requires a system that can coordinate the rolling, which can lead to mechanism failure such as the covers becoming pinched preventing their smooth operation. This system also requires personnel to operate the mechanism.

What is needed in the art is a railcar cover that can easily and repeatably slide open to expose the top of the railroad car and closed to cover the material therein.

SUMMARY OF THE INVENTION

The present invention is directed to a railcar system with linear bearings associated with the removable hatch.

The present invention consists in one form thereof of a railcar having a longitudinal axis and a movable cover. The movable cover includes a plurality of linear bearing devices and at least one slideable hatch connected to the plurality of linear bearing devices. The slideable hatch is movable substantially normal to the longitudinal axis.

An advantage of the present invention is that the linear bearing devices are spaced along the top of the cover to provide a coordinated opening of the lengthy cover.

Another advantage of the present invention is that the opening and closing devices open and close the cover without the need for human intervention.

Yet another advantage of the present invention is that the opening and closing devices are self-centering providing a coordinated opening and closing of the railcar cover hatches.

Yet another advantage of the present invention is that the opening and closing of the railcar cover occurs by the movement of the railcar under the opening and closing devices.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrates one embodiment of the invention, in one form, and such exemplification is not to be construed as limiting the scope of the invention in any manner.

DETAILED DESCRIPTION OF THE INVENTION

Figure 1:
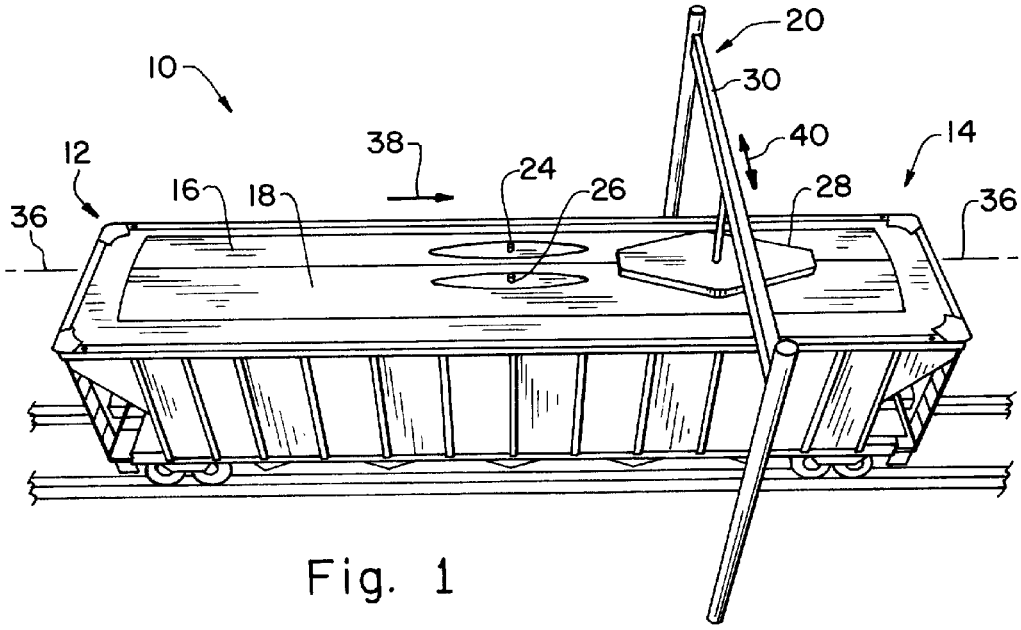
FIG. 1 is a perspective view of a railcar having an embodiment of a railcar cover of the present invention with an opening device suspended thereover.
Figure 2:
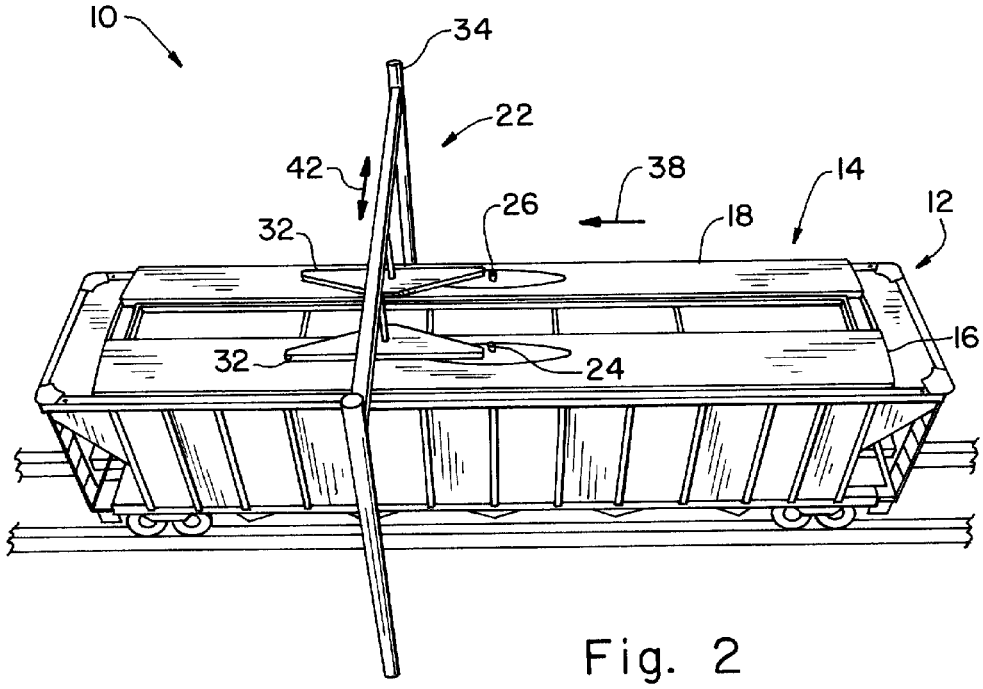
FIG. 2 is another perspective view of the railroad car of FIG. 1 about to encounter the closing device that will act to close the hatches of the railcar.

Referring now to the drawings, and more particularly to FIGS. 1 and 2, there is shown a railcar system 10 including a railcar 12 having a cover system 14 thereon. Cover system 14 includes a hatch 16 and a hatch 18 that encounter an opening system 20 as shown in FIG. 1 and a closing system 22 as shown in FIG. 2. Hatches 16 and 18 respectively have protrusions 24 and 26 extending substantially vertically from the top surface of hatches 16 and 18.

Opening system 20 includes an angled opening wedge 28 that is suspended from an overhead support 30. In a similar fashion, closing system 22 includes closing wedges 32 suspended from an overhead support 34. Railcar 12 has a longitudinal axis 36 and moves along that axis in direction 38. Angled opening wedge 28 has an adjusting direction 40 and in a like manner closing wedge 32 is adjustable in a direction 42.

As railcar 12 moves in moving direction 38 as shown in FIG. 1, protrusions 24 and 26 encounter the angled surfaces of opening wedge 28. Presuming that one of protrusions 24 or 26 encounter opening wedge 28 before the other protrusion, the opening wedge 28 is supported in a sliding manner by overhead support 30, thereby allowing opening wedge 28 to shift in an appropriate direction so as to cause protrusions 24 and 26 to diverge from each other at the same time and cause the opening process to start in a relatively uniform manner. Additionally, there may be a powered adjustment feature with sensors to also adjust wedges 28 and 32 appropriately. Additionally, an adjusting mechanism may be utilized to move wedges 28 and 32 to one side of their prospective support in the event that it is not desired to open the railcars passing beneath supports 30 and 34.

In a typical operation, the movement of the railcars is in a singular direction with railcar 12 first encountering opening system 20 and then, with hatches 16 and 18 in an open position, railcar 12 is loaded with some bulk material. As railcar 12 continues to move in direction 38, it then encounters closing system 22 as shown in FIG. 2 where closing wedge 32 encounters protrusions 24 and 26, adjusting to provide for a uniform closing of hatches 16 and 18. The movement of the wedges in directions 40 and 42 may continue up to the point the hatches 16 and 18 has completed its' travel. This system compensates for any imbalance in the frictional movement of individual hatch. For example, if hatch 16 is reluctant to move, hatch 18 may move to its full extent while hatch 16 is slow to move until hatch 18 reaches its full movement at which point sideways movement stops causing hatch 16 to receive additional force from the encountered wedge causing it then to move to its full extent. Although overhead supports 30 and 34 are illustrated, it is also anticipated that wedges 28 and 32 can be integrated into the structure of a loading operation.

Figure 3:
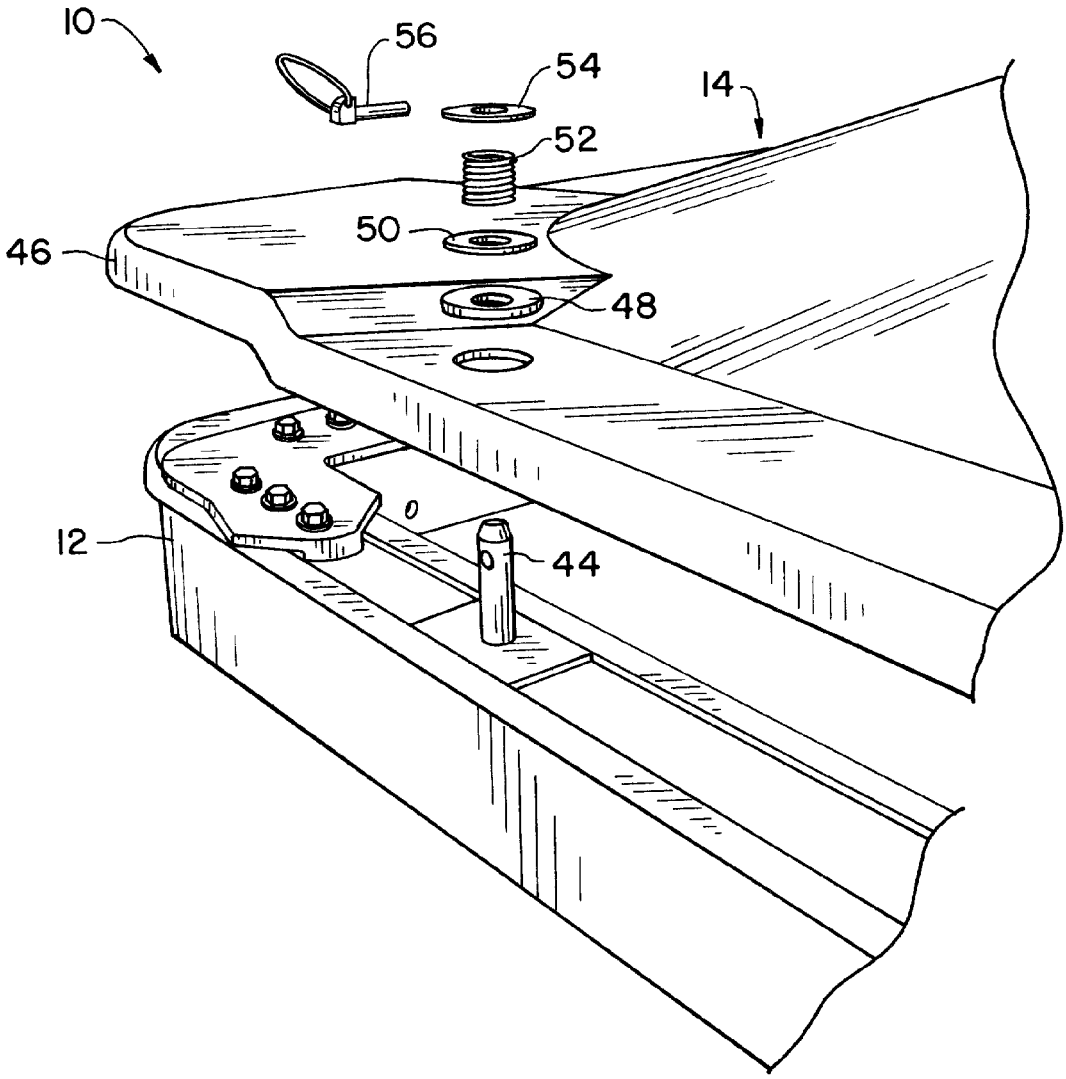
FIG. 3 is an exploded perspective view of one hold down pin system utilized on the cover of FIGS. 1 and 2.

Now, additionally referring to FIG. 3, there is shown part of the cover hold down system including a pin 44 extending from railcar 12 through an opening in cover 46 with a sealing washer 48 followed by a washer 50, a spring 52, a washer 54, and a keeper pin 56. This system advantageously allows for the quick installation and removal of cover system 14. Additionally, positioning of spring 52 allows cover 46 to move upward in the event that there is a sudden air pressure change within railcar 12. Ideally, several of the hold down systems are utilized on cover system 14 at appropriately positioned places.

Figure 4:
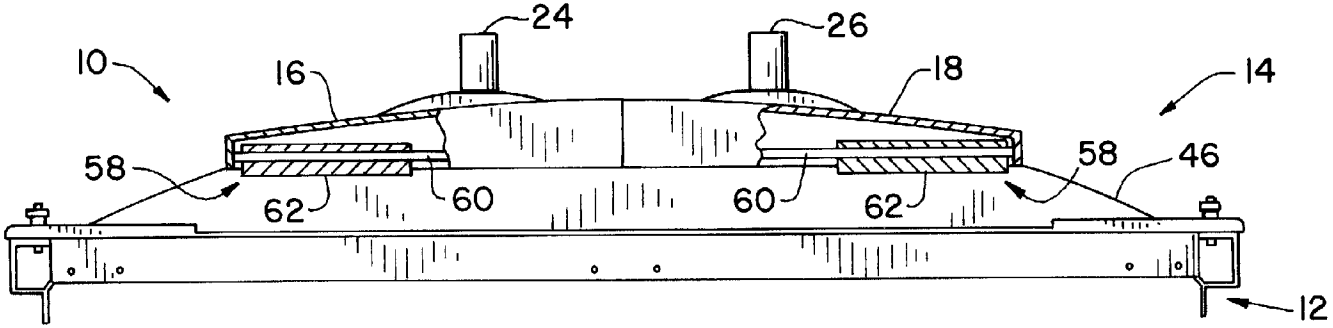
FIG. 4 is a partially sectioned end view of the cover of FIGS. 1-3 showing the hatches in the closed position.
Figure 5:
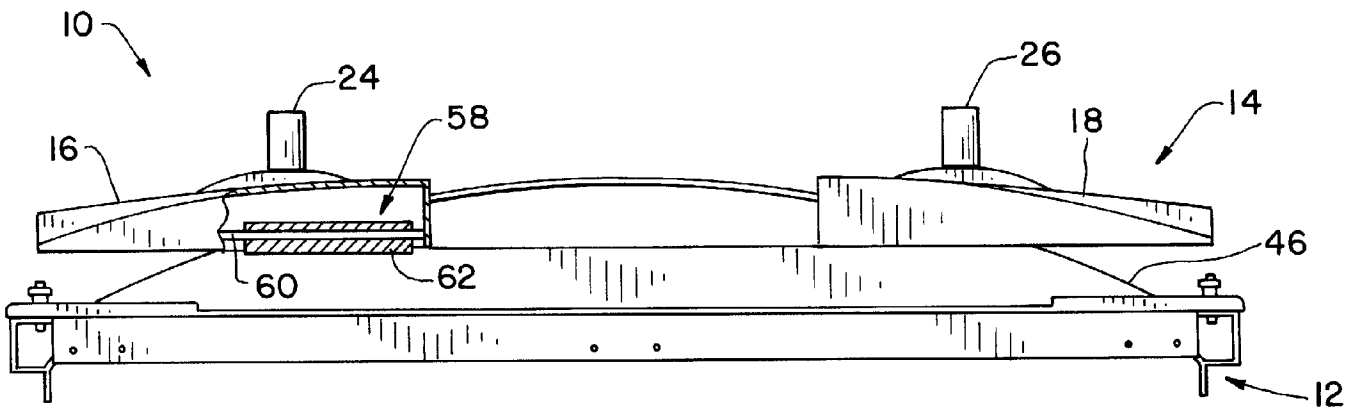
FIG. 5 is a partially sectioned view of the cover of FIGS. 1-4 shown in an open position.

Now, additionally referring to FIGS. 4 and 5, elements of the linear bearings 58, which allow hatches 16 and 18 to move are illustrated. Experimentation has shown that five linear bearings along each hatch are an optimal number of linear bearings for each hatch cover. Other numbers of linear bearings utilized are also contemplated. Linear bearings 58 include a rod 60 that extends through a bearing 62. Rod 60 extends from one edge of the cover to the other edge substantially perpendicular to longitudinal axis 36. Rod 60 may be circular in cross section although other shapes are also contemplated. Bearing 62 has a cavity that is shaped to match the shape of rod 60 and bearing 62 is made of a low friction material to allow rod 60 to slide therethrough. Bearing 62 may be substantially half the length of rod 60 to provide a long bearing surface thereby reducing or eliminating the possibility of hatch 16 or 18 from cocking or pinching while it moves. Bearing 62 is made from a low friction material and has a consistency that has a substantially constant density along its length. Additionally, other configurations are also contemplated such as two bearings 62 separated by a space being positioned to support rod 60. Hatches 16 and 18 are configured to slide toward and away from each other in a coordinated manner by utilizing wedges 28 and 32. However, hatches 16 and 18 are not constrained to open in a coordinated manner. Further hatches 16 and 18 advantageously do not require any mechanism carried by railcar 12 to open or close them. The opening and closing devices, since they are slideable in a direction that is substantially normal to longitudinal axis 36 allows the opening and closing devices to be self-centering relative to protrusions 24 and 26. Opening wedges 28 and closing wedges 32 are stationary relative to the railcar in the longitudinal direction as the railcar passes through opening system 20 and closing system 22.

Figure 6:
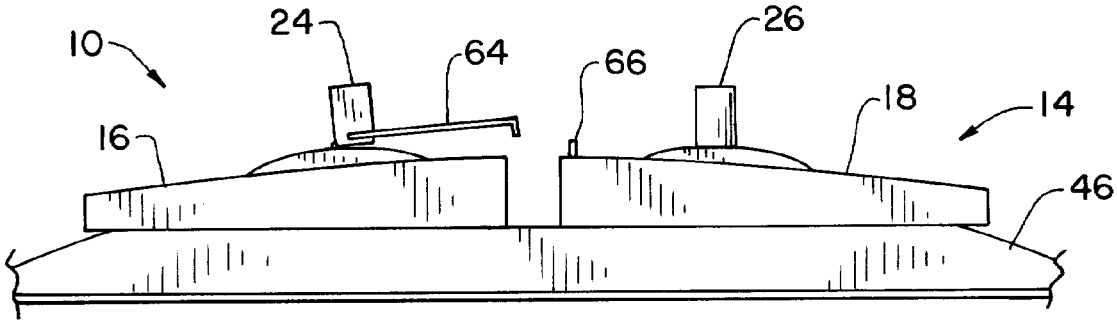
FIG. 6 is a partial end view illustrating an embodiment of a latching mechanism utilized with the cover of FIGS. 1-5.

Now additionally referring to FIG. 6, there is illustrated a hatch latch 64 that is configured to latch hatch 16 to hatch 18 when they are slid together. Opening system 20 also provides for the automatic unlatching of hatches 16 and 18 when the opening sequence starts. The unlatching is illustrated as protrusion 24 is allowed to hinge a predetermined amount to thereby lift latch 64 from catch 66. Closing system 22 in a similar fashion causes the hatch latch to latch before shipping. This is accomplished by latch 64 being itself hinged relative to protrusion 24 having a wedge shaped end that encounters catch 66 to thereby allow latch 64 to hook to catch 66. Other latching mechanisms are contemplated including magnetic latches.

While the opening and closing of hatches 16 and 18 has been discussed relative to a filling operation, it is also anticipated that hatches 16 and 18 will be at least partially opened during an emptying operation to preclude any damage that might occur by the rapid removal of bulk material which may cause a vacuum within railcar 12. Alternatively, a pressure relief valve system may be part of cover system 14. For example, a pressure relief valve may be an integral part of protrusions 24 and 26 extending through the middle thereof.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A railcar system, comprising:

a railcar having a longitudinal axis; and a movable cover including:

a plurality of linear bearing devices; and at least one slidable hatch connected to said plurality of linear bearing devices, said slidable hatch being movable substantially normal to said longitudinal axis, said at least one slidable hatch includes a first slidable hatch and a second slidable hatch that are configured to slide away from each other to reveal an opening in said cover and toward each other to close the opening in said cover, said first slidable hatch and said second slidable hatch each have an upwardly extending protrusion;

an opening device configured to be positioned between said protrusions to open said first slidable hatch and said second slidable hatch as said railcar system moves relative to said opening device; and a closing device configured to contact said protrusions to close said first slidable hatch and said second slidable hatch as said railcar system moves relative to said closing device.

2. The railcar system of claim 1, wherein at least one of said opening device and said closing device is slidable in a direction substantially normal to said longitudinal axis thereby being configured to self center relative to said protrusions.

3. The railcar system of claim 2, wherein said opening device and said closing device are each stationary relative to said railcar in said longitudinal direction.

4. The railcar system of claim 3, further comprising a hatch latch configured to latch said first slidable door to said second slidable door, said opening device being configured to unlatch said hatch latch and said closing device being configured to cause said hatch latch to latch.

5. A railcar cover system for use with a railcar, the railcar having a longitudinal axis, the railcar cover system, comprising:

a cover attachable to the railcar, the cover including:

a plurality of linear bearing devices; and at least one slidable hatch connected to said plurality of linear bearing devices, said slidable hatch being movable substantially normal to said longitudinal axis, said at least one slidable hatch includes a first slidable hatch and a second slidable hatch that are configured to slide away from each other to reveal an opening in said cover and toward each other to close the opening in said cover, said first slidable hatch and said second slidable hatch each have an upwardly extending protrusion;

an opening device configured to be positioned between said protrusions to open said first slidable hatch and said second slidable hatch as the railcar moves relative to said opening device; and a closing device configured to contact said protrusions to close said first slidable hatch and said second slidable hatch as the railcar moves relative to said closing device.

6. The railcar cover system of claim 5, wherein at least one of said opening device and said closing device is slidable in a direction substantially normal to said longitudinal axis thereby being configured to self center relative to said protrusions.

7. The railcar cover system of claim 6, wherein said opening device and said closing device are each stationary relative to the railcar in said longitudinal direction.

8. The railcar cover system of claim 7, further comprising a hatch latch configured to latch said first slidable door to said second slidable door, said opening device being configured to unlatch said hatch latch and said closing device being configured to cause said hatch latch to latch.

* * * * *